US005445549A

United States Patent [19]

Lekhtman

[11] Patent Number: 5,445,549

[45] Date of Patent: Aug. 29, 1995

[54] WATER SPORTING EQUIPMENT

[75] Inventor: David Lekhtman, Morin Heights, Canada

[73] Assignee: Damar Leisure Products Inc., Montreal, Canada

[21] Appl. No.: 156,310

[22] Filed: Nov. 22, 1993

[51] Int. Cl.[6] ..... B63H 16/08

[52] U.S. Cl. ..... 440/17; 440/21

[58] Field of Search ..... 441/76, 77; 440/21, 440/12, 17, 26, 15, 30

[56] References Cited

U.S. PATENT DOCUMENTS

| | | | |
|---|---|---|---|
| 892,418 | 7/1908 | Hallman | 440/25 |
| 2,430,466 | 11/1947 | Hedman . | |
| 2,663,278 | 12/1953 | Skinner | 440/26 |
| 3,747,236 | 7/1973 | Sidlauskas | 36/25 AA |
| 3,783,532 | 1/1974 | Harradine | 36/25 AA |
| 4,789,365 | 12/1988 | Jones | 440/21 |

FOREIGN PATENT DOCUMENTS

| | | | |
|---|---|---|---|
| 0064913 | 12/1955 | France | 440/12 |

*Primary Examiner*—Sherman Basinger
*Attorney, Agent, or Firm*—Fishman, Dionne & Cantor

[57] ABSTRACT

The equipment includes a device for floating on the surface of a body of water and for supporting at least one user, and footwear worn by the user for propelling the device through the water. The device for floating includes at least two spaced, parallel, side-by-side pontoons and a frame connected to the pontoons and extending above the space between the pontoons for supporting the user in the space between the pontoons. The footwear includes a foot receiving portion having a foot receiving surface and a second surface opposite to the foot receiving surface and fins extending downwardly from the second surface.

5 Claims, 1 Drawing Sheet

WATER SPORTING EQUIPMENT

BACKGROUND OF INVENTION

1. Field of the Invention

The invention relates to a water sporting equipment comprising, in combination, a device for floating on the water and supporting at least one user thereon, and footwear worn by the user for propelling the device through the water. The invention also relates to the floating device and the footwear.

2. Description of Prior Art

It is known in the art to provide devices for carrying a user on the surface of a body of water or other fluid. Such devices are illustrated in, for example, U.S. Pat. No. 2,430,466, Hedman, Nov. 11, 1947, U.S. Pat. No. 3,747,236, Sidlauskas, Jul. 24, 1973, U.S. Pat. No. 3,783,532, Harradine, Jan. 8, 1974.

The '466 Patent teaches an inflatable boot made of rubber or other flexible and elastic material which can support a user on the surface of a body of water or other fluid.

The '236 Patent teaches a floatation shoe made of a floatable material and including downwardly extending fins and a rear fin.

The '532 Patent teaches pontoon-like shoes having downwardly extending fins.

In all the prior art devices, the shoes themselves are floatable and provide full support for the user on the body of the surface of water or other fluid.

SUMMARY OF THE INVENTION

It is an object of the invention to provide sporting equipment which comprises, in combination, a device for floating on the water and supporting at least one user thereon, and footwear worn by the user for propelling the device through the water.

In accordance with the invention, the floating device comprises two side-by-side pontoons and means, connected to the pontoons, for supporting the user between the pontoons.

The footwear comprises a foot engaging portion having a foot engaging surface and an opposite surface. Fins extend downwardly from the opposite surface.

In accordance with a particular embodiment of the invention there is provided water sporting equipment comprising, in combination:

A) a device for floating on the surface of a body of water and for supporting at least one user thereon, said device comprising;
   i) at least two spaced, parallel, side-by-side pontoons;
   ii) support means, connected to said pontoons, and extending above the space between said pontoons, for supporting said user in the space between said pontoons;

B) footwear worn by said user for propelling said device through the water, comprising;
   i) a foot receiving portion having a foot receiving surface and a second surface opposite to said foot receiving surface;
   ii) fin means extending downwardly from said second surface.

Also in accordance with a particular embodiment of the invention, there is provided, for use with water sporting equipment, a device for floating on the surface of a body of water and for supporting at least one user thereon, said device comprising;

at least two spaced, parallel, side-by-side pontoons;

support means connected to said pontoons and extending above the space between said pontoons for supporting said user in the spaced between said pontoons;

said support means comprising a seat in the space between said pontoons and support elements extending from said pontoons to said seat.

Also in accordance with a particular embodiment of the invention there is provided, for use with water sporting equipment, including a device for floating on the surface of a body of water and for supporting at least one user thereon;

footwear worn by said user for propelling said device through the water;

said footwear comprising;

a foot receiving portion having a foot receiving surface and a second surface opposite to said foot receiving surface;

fin means extending downwardly from said second surface;

said foot receiving portion being substantially the same size as the bottom surface of said user's foot.

BRIEF DESCRIPTION OF DRAWINGS

The invention will be better understood by an examination of the following description, together with the accompanying drawings, in which.

DESCRIPTION OF PREFERRED EMBODIMENTS

Figure 1:
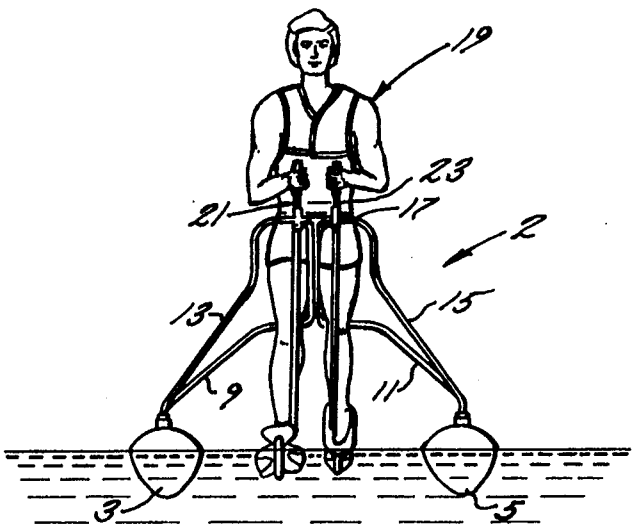
FIG. 1 is a front view of the water sporting equipment mounting a user.
Figure 2:
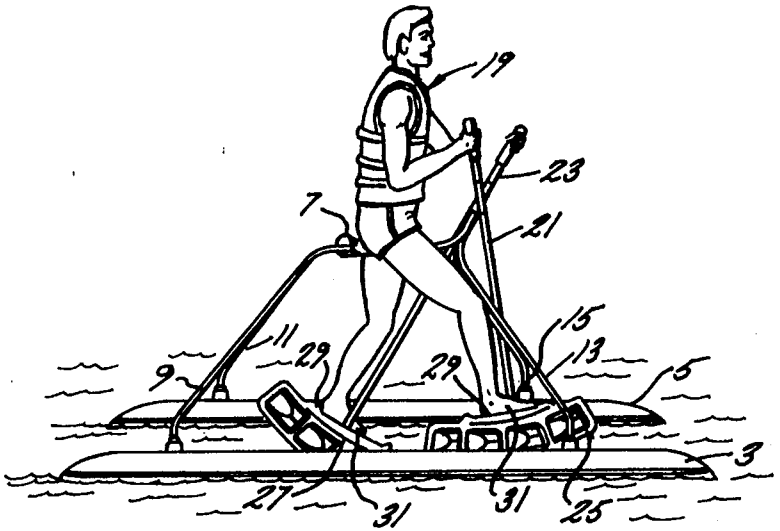
FIG. 2 is a side view of FIG. 1.

Referring to FIGS. 1 and 2, the floating device, referenced generally at 1, comprises two spaced, parallel, side-by-side floats or pontoons 3 and 5. Extending above the pontoons and in the space between the two pontoons is a seat 7. The seat is supported by rear support elements 9 and 11 each of which is connected, at its bottom end, to the top surface of the pontoons 3 and 5 respectively, and, at their top ends, to the seat 7. Front support elements 13 and 15 are also connected at their bottom ends, to the top surfaces of pontoons 3 and 5, and, at their top ends to a handle bar 17. The handle bar 17 is, in turn, connected to the front end of seat 7. As can be seen, a user 19 is supported on the seat 7 so that his legs extend in the space between the pontoons 3 and 5.

As can be seen, the user 19 may use poles 21 and 23 which are pivoted with respect to the handle bar 17 and are attached to footwear 25 and 27, respectively. Thus the footwear 25 and 27 can each reciprocate in an arc. The top ends of poles 21 and 23 can be in the form of handles to be grasped by the user 19.

In both embodiments, the user uses propulsion. The footwear comprises a foot receiving portion 29 which receives the foot 31 of the user on a foot receiving surface thereof. It can be seen that the foot receiving portion is substantially the same size as the foot of the user.

Figure 3:
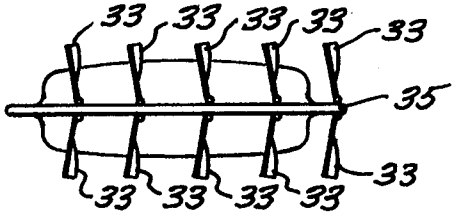
FIG. 3 illustrates the footwear worn by the user in open position.
Figure 4:
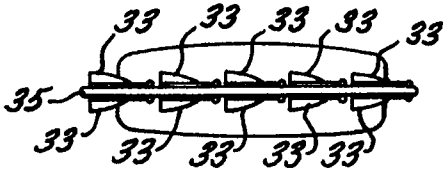
FIG. 4 illustrates the footwear worn by the user in closed position.

As also seen in FIG. 4, a plurality of fins 33 extend downwardly from the surface opposite the foot receiving surface of the foot receiving portion. The fins 33 are pivotable about center member 35 so that they are in an open position (FIG. 3) when the leg of the user is moving backward to provide propulsion; and in a closed position (FIG. 4) when the leg of user 19 moves forward.

In operation, a user mounts the floating device by seating himself on the seat 7. To propel the floating device, the user exercises a walking motion and the action of the fins pushing against the water will propel the user and the floating device.

Although in the illustrated embodiment the floating device is illustrated as supporting a single user, obviously, the floating device can be structured to support two or more users. In one such embodiment, two seats would be disposed between the pontoons 3 or 5. In an alternate embodiment, the floating device would include three spaced parallel pontoons, and one seat would be disposed between each of the spaces in the arrangement.

Although particular embodiments have been described, this was for the purpose of illustrating, but not limiting, the invention. Various modifications, which will come readily to the mind of one skilled in the art, are within the scope of the invention as defined in the appended claims.

I claim:

1. Water sporting equipment comprising, in combination:

A) a device for floating on the surface of a body of water and for supporting at least one user thereon, said device comprising;

i) at least two spaced, parallel pontoons;

ii) a frame, connected to said pontoons, and extending above the space between said pontoons, the frame mounting a seat for the user;

B) a pair of elongated members pivoted with respect to the frame, forward of the seat, about an axis at right angle to the pontoons, the elongated members each including an independent footwear fixedly mounted to the bottom end of the respective elongated member for arcuate reciprocating movement relative to the device for engaging the water and for propelling the device through the water in a direction parallel to the pontoons, said footwear comprising;

i) a foot receiving portion having a foot receiving surface and a second surface opposite to said foot receiving surface;

ii) fin means movably connected to the footwear whereby the fins will close when the footwear is moving forward in the water relative to the device and will open when the footwear is moved rearwardly relative to the device to provide propulsion to the device.

2. Water Sport equipment as defined in claim 1 wherein said frame comprises;

rear support elements extending from the rear of said seat to the top surfaces of said pontoons; and front support elements extending forward of said seat to the top surface of said pontoons.

3. Water sport equipment as defined in claim 1, wherein handles are provided on the upper end of each elongated member forward of the seat;

front support elements extending forward of the seat and including pivot means for said elongated members; and said seat being horizontally disposed.

4. Water sporting equipment as defined in claim 1, wherein said fins are pivotable about a center member between a closed position and an open position.

5. Water sporting equipment as defined in claim 4, wherein the width of said fins is greater than the width of said foot receiving portion.

* * * * *